US005941719A

United States Patent [19]

Hayakawa

[11] Patent Number: 5,941,719

[45] Date of Patent: Aug. 24, 1999

[54] ELECTRICAL CONNECTION BOX WITH WATER DRAINAGE STRUCTURE FOR USE IN A VEHICLE

[75] Inventor: Tatsuya Hayakawa, Mie, Japan

[73] Assignee: Sumitomo Wiring Systems, Ltd., Yokkaichi, Japan

[21] Appl. No.: 08/902,078

[22] Filed: Jul. 29, 1997

[30] Foreign Application Priority Data

Jul. 29, 1996 [JP] Japan ..... 8-199151

[51] Int. Cl.[6] ..... H01R 4/64

[52] U.S. Cl. ..... 439/206

[58] Field of Search ..... 439/206, 271, 439/190–4

[56] References Cited

U.S. PATENT DOCUMENTS 4,781,621 11/1988 Sugiyama et al. .

4,954,085 9/1990 Inoue et al. ..... 439/206

5,447,445 9/1995 Torii et al. ..... 439/206

*Primary Examiner*—Steven L. Stephan

*Assistant Examiner*—Eugene G. Byrd

*Attorney, Agent, or Firm*—Oliff & Berridge, PLC

[57] ABSTRACT

An electrical connection box for use in a vehicle, particularly a car, has a casing, and a stack of bus bars and insulation plates alternating in a vertical direction. For drainage of water penetrating onto the stack, each insulation plate has a drainage aperture and a drainage wall extending downwardly from its aperture so as to define and surround a drainage passage. At least each of the insulation plates below the upper plate has on its upper surface a flow interruption rib upstanding continuously around its drainage aperture. Water on one bus bar does not connect the bus bar conductively to another bus bar.

7 Claims, 3 Drawing Sheets

ELECTRICAL CONNECTION BOX WITH WATER DRAINAGE STRUCTURE FOR USE IN A VEHICLE

BACKGROUND OF THE INVENTION

1. Field of Invention

The present invention relates to an electrical connection box for use in a vehicle, especially a car and more particularly to an electrical connection box in which vertically stacked bus bars can be prevented from becoming electrically conductive to each other when water enters a casing accommodating the bus bars. The invention also relates to such a box when mounted in a vehicle, e.g. an automobile.

2. Description of Related Art

In this kind of electrical connection box, in order to prevent leakage of current between the bus bars as a result of water penetration from the upper part of the casing while a car is being cleaned, a drainage path for passing water to the lower part of the casing is formed between the periphery of a stack having bus bars and insulation plates and the inner side surface of the casing, to discharge water to the outside via a drainage hole formed at the lower part of the casing.

To discharge water that has not passed via a drainage hole 5*a* formed between the periphery of the stack and the inner side surface of the casing, but has penetrated into the interior of the stack along the upper surface of the insulation plates, a drainage construction shown in FIGS. 6 and 7 can be provided. FIG. 6 is disclosed in Laid-Open Japanese Utility Model Publication No. 3-48322. In this drainage construction, a drainage hole 3 is formed in an upper insulation plate 1A of the stack, which includes bus bars 2A, 2B, 2*c* and insulation plates 1A, 1B. A drainage cylinder 4 projects from the periphery of the drainage hole 3 to the bottom of the stack. Water that has penetrated into the electrical connection box falls through the drainage hole 3 and the interior of the drainage cylinder 4 to be discharged to the outside via the drainage hole 5*a* of the lower casing 5.

FIG. 6 also shows that the insulation plate 1B has a drainage cylinder similar to the drainage cylinder 4. In the above-described embodiment, the water on the upper surface of the upper insulation plate 1A can be discharged to the outside. However, as shown in FIG. 7—which shows insulation plates 1A, 1B, 1*c* and bus bars 2A, 2B, 2*c*—there is a possibility that water (d) which has passed from the inner side surface of the casing to the upper surface of insulation plates (e.g., 1B and 1*c*) below the upper insulation plate 1A, drops from the ends (i.e. the ends adjacent to the drainage cylinder 4 in FIG. 7) of the insulation plates 1B, 1*c*, surrounding the drainage cylinder 4 onto the insulation plates below or onto the bus bars below. For example, there is a possibility that water flows from the end of the intermediate insulation plate 1B onto the upper surface of the lower insulation plate 1*c* adjacent to the intermediate insulation plate 1B. Consequently, the bus bar 2B installed on the intermediate insulation plate 1B and the bus bar 2*c* installed on the lower insulation plate 1*c* can be made electrically conductive to each other through the water.

SUMMARY OF THE INVENTION

The present invention seeks to reduce or avoid the above-described problem. It is an object of the present invention to prevent vertically stacked bus bars from becoming electrically conductive to one another when water flows along the upper surfaces of insulation plates stacked with the bus bars inside an electrical connection box.

According to the present invention, there is provided an electrical connection box for use in a vehicle including a casing, a plurality of bus bars, and a plurality of insulation plates having upper and lower surfaces. The bus bars and the insulation plates are arranged in the casing as a vertical stack in which the insulation plates alternate in the vertical direction with the bus bars. Each insulation plate in the stack has a drainage aperture and a drainage wall extending downwardly from the aperture to define and surround a drainage passage from the aperture. At least each of the insulation plates other than the upper plate in the stack has on its upper surface a flow interruption rib upstanding continuously around the drainage aperture thereof.

In one preferred embodiment of the invention the flow interruption ribs can be spaced from the drainage apertures, and the drainage wall of each insulation plate may contact the upper surface of the next lower insulation plate in the stack between the flow interruption rib and the aperture of the next lower insulation plate, whereby the drainage walls and apertures together form a continuous drainage path extending to the bottom of the stack. In this embodiment, water which has penetrated into the casing and flows along the upper surface of each insulation plate reaches the drainage aperture, thus meeting the flow interruption rib projecting upward. Water which has not passed the interruption rib flows to the periphery of the insulation plate, and drops through a drainage path formed between the inner side surface of the casing and the insulation plates. Because the drainage wall of each insulation plate is effectively continuous with the drainage wall of the next lower insulation plate, water drops reliably to the lower end of the stack. Thus, water can be prevented from dropping via the drainage apertures to the insulation plates vertically adjacent to each other. Accordingly, it is possible to prevent the bus bars from becoming electrically conductive to each other.

In another preferred embodiment of the present invention, each drainage wall of each respective insulator plate may extend to the bottom of the stack through the drainage aperture of each of the insulator plates below in the stack, with the drainage wall of each respective insulation plate surrounding the drainage wall of each of the insulation plates above in the stack. In this embodiment, water which has reached the drainage aperture along the upper surface of each insulation plate can reliably fall to the lower end of the stack through the drainage cylinder, which is continuous with the drainage aperture of the insulation plate and extends to the lower end of the stack. Accordingly, water flowing along the upper surface of the insulation plate can be prevented from dropping to the adjacent insulation plate through the drainage aperture. Thus, again, it is possible to prevent the bus bars from being electrically conductive to each another.

In this embodiment in which the drainage walls are nested one within another, the thickness of the drainage walls may be smaller than that of other parts, e.g., the insulation plate itself, so that the space occupied by the drainage walls can be reduced.

BRIEF DESCRIPTION OF THE DRAWINGS

These and other features of the present invention will become clear from the following description of the preferred embodiments, with reference to the accompanying drawings, throughout which like parts are designated by like reference numerals, and in which.

DETAILED DESCRIPTION OF PREFERRED EMBODIMENTS

Figure 1:
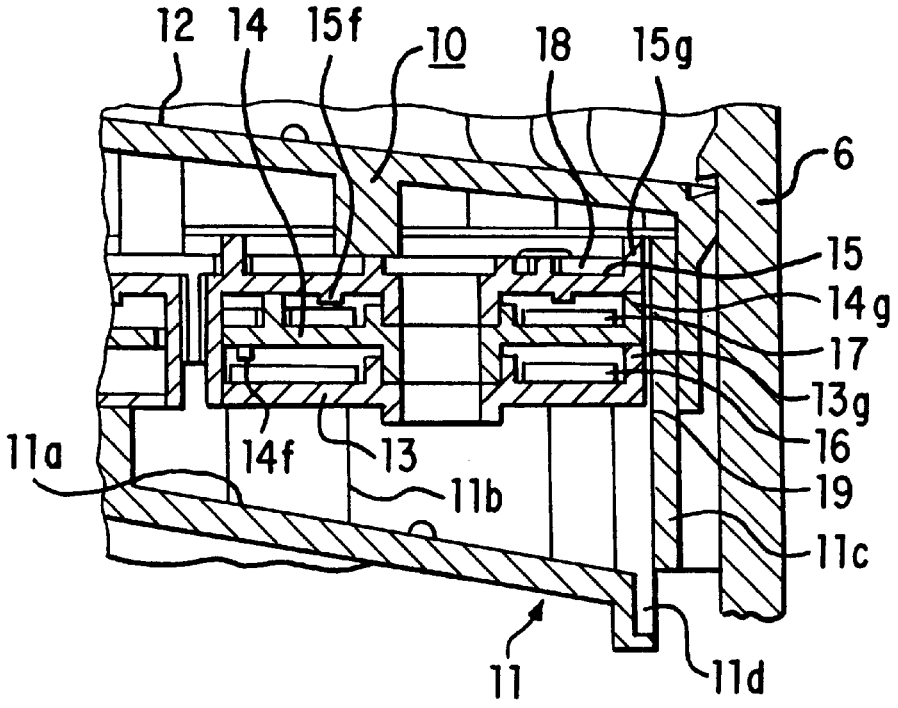
FIG. 1 is a vertical sectional view showing part of a first electrical connection box embodying the present invention.
Figure 2:
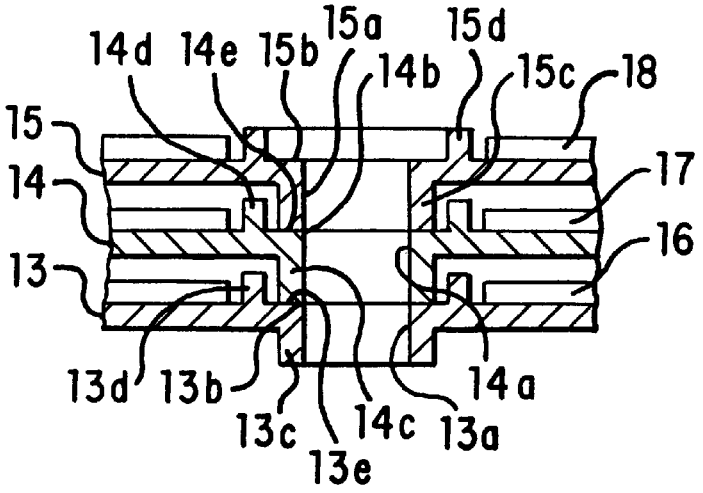
FIG. 2 is an enlarged sectional view showing a portion of the electrical connection box of FIG. 1.
Figure 3:
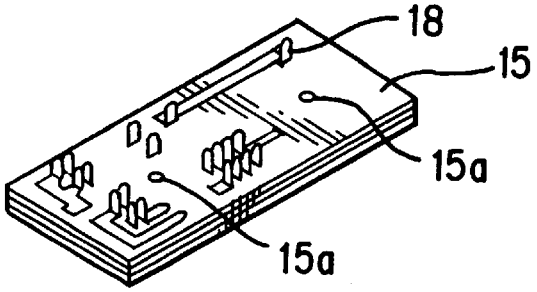
FIG. 3 is a schematic perspective view showing the stack of bus bars and insulation plates of the electrical connection box of FIG. 1.

FIGS. 1–3 show a first embodiment of the invention. An electrical connection box 10, partly shown in FIG. 1, accommodates a stack comprising insulation plates 13, 14, 15 stacked alternately in the vertical direction with bus bars 16, 17, 18 in a casing. The casing is assembled by lockably fitting a lower casing part 11 and an upper casing part 12 to each other. The lower and upper casing parts 11, 12 are mounted within an outer casing 6 of the electrical connection box 10.

More specifically, the lower insulation plate 13 is supported by a supporting portion 11*b* projecting from a bottom wall 11*a* of the lower casing part 11, and the lower bus bar 16 is mounted on the upper surface of the lower insulation plate 13. On the upper surface of the lower bus bar 16, the intermediate insulation plate 14, the intermediate bus bar 17, the upper insulation plate 15 and the upper bus bar 18 are sequentially arranged. The predetermined gap interval between the lower and intermediate bus bars 16, 17 and the intermediate insulation plate and upper insulation plates 14, 15, respectively, are maintained by the provision of bosses 14*f* and 15*f*, respectively projecting from the lower surface of the intermediate and upper insulation plates 14, 15.

In the stacked insulation plates 13, 14, 15, there are respectively formed drainage holes 13*a*, 14*a*, 15*a* communicating vertically with each other at two locations shown in FIG. 3. The drainage holes 13*a*, 14*a*, 15*a* are formed at appropriate positions where the bus bars 16, 17, 18 are not present. The drainage holes may be formed at only one location or at two or more locations.

On the insulation plates 13, 14, 15, there are formed drainage cylinders 13*c*, 14*c*, 15*c* projecting downwardly from each of the respective peripheries 13*b*, 14*b*, 15*b* of the drainage holes 13*a*, 14*a*, 15*a*. Further, on the upper insulation plate 15, there is formed a continuous cylindrical interruption rib 15*d* projecting upwardly from the drainage hole periphery 15*b* at a small radial spacing from the hole 15*a*. Likewise on the intermediate and lower insulation plates 14, 13, there are formed continuous cylindrical interruption ribs 14*d*, 13*d* projecting upwardly from the drainage hole peripheries 14*b*, 13*b* and spaced by a predetermined amount from the drainage hole peripheries 14*b*, 13*b*.

The upper drainage cylinder 15*c* projecting from the upper insulation plate 15 is fitted against the inner peripheral surface of the interruption rib 14*d* of the intermediate insulation plate 14. The lower surface of the upper drainage cylinder 15*c* contacts the upper surface 14*e* of the intermediate insulation plate 14 between the drainage hole 15*a* and the interruption rib 14*d* so as to connect the drainage cylinders 15*c*, 14*c* with each other vertically. Similarly, the intermediate drainage cylinder 14*c* projecting downwardly from the intermediate insulation plate 14 is fitted against the inner peripheral surface of the interruption rib 13*d* of the lower insulation plate 13, and similarly the lower surface of the intermediate drainage cylinder 14*c* contacts the upper surface 13*e* of the lower insulation plate 13 between the interruption rib 13*d* and the drainage hole 13*a* so as to connect the drainage cylinders 14*c*, 13*c* with each other vertically. The lower drainage cylinder 13*c* of the lower insulation plate 13 projects downwardly a certain distance.

The upper, intermediate and lower drainage cylinders 15*c*, 14*c*, 13*c* have the same inner diameter and are vertically continuous with each other so as to constitute a single cylindrical drainage path.

The height of the interruption ribs 13*d*, 14*d*, 15*d* is greater than the thickness of the respective bus bars 16, 17, 18 mounted on the lower, intermediate and upper insulation plates 13, 14, 15, respectively. The height of the intermediate interruption rib 14*d* and of the lowermost interruption rib 13*d* may be such that they contact the lower surface of the next adjacent insulation plate 15 and insulation plate 14, respectively.

Protection walls 13*g*, 14*g*, 15*g* project upwardly from the periphery of each of the stacked insulation plates 13, 14, 15, respectively. The protection wall 13*g* contacts the lower surface of the intermediate insulation plate 14, and the protection wall 14*g* contacts the lower surface of the upper insulation plate 15 so that the protection walls 13*g*, 14*g*, 15*g* are continuous with each other vertically to prevent the penetration of water into the stack from the peripheries of the insulation plates 13, 14, 15. A drainage gap 19 is formed between the protection walls 13*g*, 14*g*, 15*g* and the inner surface of a side wall 11*c* of the lower casing part 11. A drainage hole 11*d* is formed in the bottom wall 11*a* of the lower casing part 11 below the drainage gap 19.

In the electrical connection box 10 having this construction, when water has penetrated into the lower casing part 11 and/or the upper casing part 12, it is discharged to the drainage hole 11*d* via the drainage gap 19 formed between the side wall 11*c* of the lower casing part 11 and the stack of insulation plates 13, 14, 15 and bus bars 16, 17, 18. Any water flowing along the upper surfaces of any of the insulation plates 13, 14, 15 after passing the protection walls 13*g*, 14*g*, 15*g*, reaches the peripheries 13*b*, 14*b*, 15*b* of the drainage holes 13*a*, 14*a*, 15*a*, and drops downward along the inner surface of the drainage cylinders 13*c*, 14*c*, 15*c*. Water which does not pass the interruption ribs 13*d*, 14*d*, 15*d* is discharged downward via the gap 19 at the periphery of the stack or vaporizes. The cooperation of the drainage cylinders 13*c*, 14*c*, 15*c* with the interruption ribs 14*d*, 15*d* helps to ensure that no water can accumulate which might provide a conduction path between bus bars 16, 17, 18. The water leak path from the drainage path through the drainage cylinders 13*c*, 14*c*, 15*c* onto bus bars 16, 17 is tortuous. Thus, essentially no possibility arises that water collects in such a way as to cause the vertically stacked bus bars to become electrically conductive to each other.

Even though water which enters the upper drainage cylinder 15*c* flows along the inner surface thereof, it continues downward along the inner surface of the intermediate drainage cylinder 14*c*, because the inner surface of the lower end of the upper drainage cylinder 15*c* is continuous with the inner surface of the upper end of the intermediate of drainage cylinder 14*c*. Then, the water flows downward along the inner surface of the lower drainage cylinder 13*a*, thus reliably flowing downwardly to the lower end of the stack through the drainage cylinders 13*c*, 14*c*, 15*c*.

Consequently, the water flowing along the upper surface of the upper insulation plate 15 drops through the stack via the drainage holes. Thus, the bus bars 16, 17, and 18 can be reliably prevented from being made electrically conductive to each other by the penetration of water into the casing.

Figure 4:
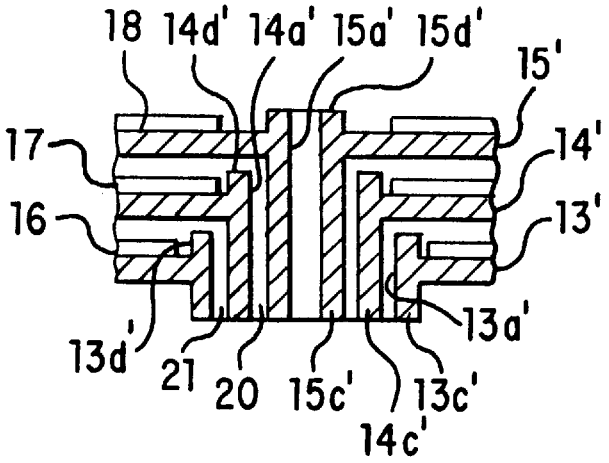
FIG. 4 is a vertical sectional view showing a portion of a second electrical connection box embodying the present invention.

FIG. 4 shows a second embodiment which is otherwise similar to that of FIGS. 1 to 3 but in which drainage cylinders 13*c*′, 14*c*′, 15*c*′ project downwardly from the periphery of each of the drainage holes 13*a*′, 14*a*′, 15*a*′ in the insulation plates 13', 14', 15', each extending to the lower side of the stack of insulation plates and bus bars. The drainage cylinders 13*c*′, 14*c*′ 15*c*′ are thus overlapping and concentric with each other. Similar to the first embodiment, interruption ribs 13*d*′, 14*d*′, 15*d*′ are formed on the upper surfaces of each of the insulation plates 13*c*′, 14*c*′, 15*c*′, for example, at the peripheries of the respective drainage holes 13*a*′, 14*a*′, 15*a*′.

Thus, in this second embodiment, the periphery of the drainage cylinder 15*c*′ projecting down from the upper insulation plate 15' is located within the drainage cylinder 14*c*′ projecting down from the intermediate insulation plate 14' with a drainage gap 20 provided between them. The periphery of the drainage cylinder 14*c*′ is within the drainage cylinder 13*c*′ projecting down from the lowermost insulation plate 13' with a drainage gap 21 provided between them.

Water which has penetrated into the casing and flows along the upper surface of the upper insulation plate 15' drops through the drainage cylinder 15*c*′; water flowing along the upper surface of the intermediate insulation plate 14' drops through the gap 20 formed between the drainage cylinders 15*c*′, 14*c*′; and water flowing along the upper surface of the lower insulation plate 13' drops through the gap 21 formed between the drainage cylinders 14*c*′, 13*c*′. Thus, in the second embodiment as well, water on any one of the insulation plates is prevented from dropping to a lower insulation plate. The vertically stacked bus bars can be reliably prevented from becoming electrically conductive to each other due to water.

Figure 5:
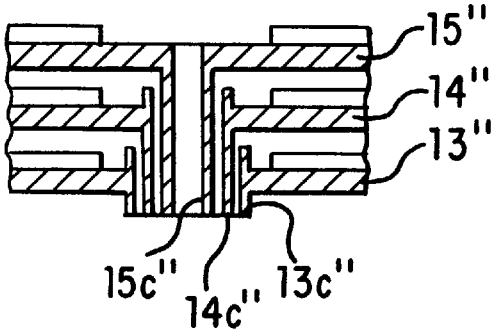
FIG. 5 is a vertical sectional view showing a portion of a third electrical connection box embodying the invention.
Figure 6:
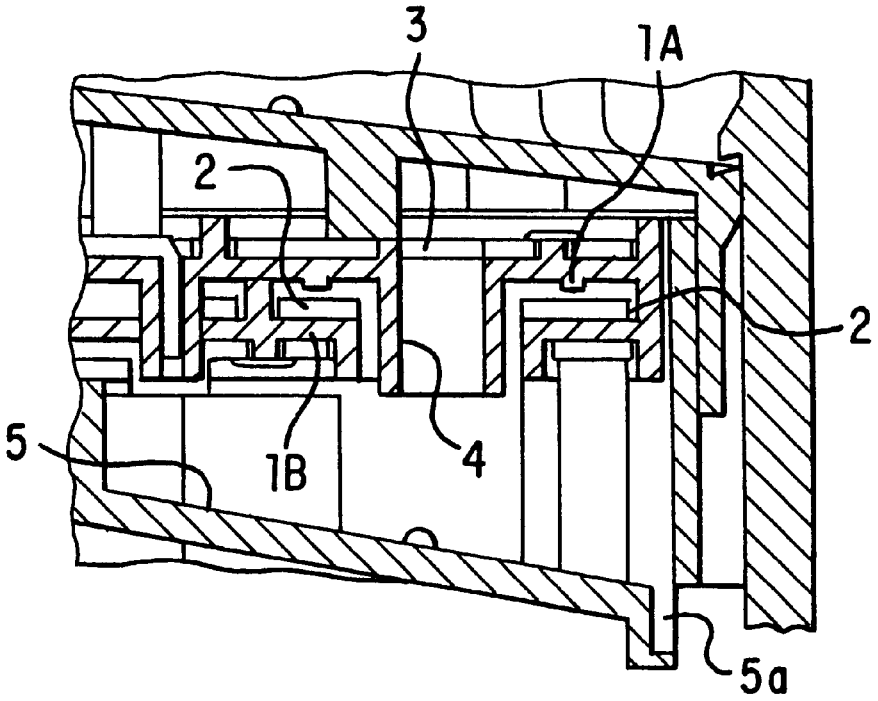
FIG. 6 PRIOR ART
FIG. 6 is a vertical sectional view showing part of a prior art electrical connection box.
Figure 7:
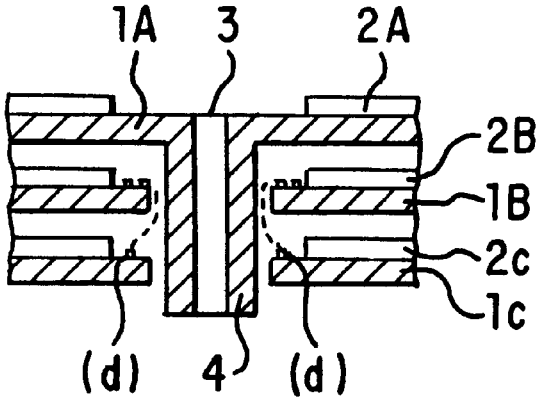
FIG. 7 PRIOR ART
FIG. 7 is a view illustrating the problem of the known electrical connection box shown in FIG. 6.

FIG. 5 shows a third embodiment, which differs from the second embodiment in that the thickness of the drainage cylinders 13*c*″, 14*c*″, 15*c*″ projecting downwardly from each of the lower, intermediate and upper insulation plates 13", 14", 15" is smaller than that of the plates themselves so that the space occupied by the drainage cylinders fitted one within another can be reduced. The upper insulation plate 15" has no protection rib at the periphery of its drainage hole.

As is apparent from the foregoing description, in the electrical connection box according to the present invention, water flowing along the upper surface of each of the vertically stacked insulation plates enters the drainage holes and falls below the stack. Thus, water can be prevented from dropping to a lower insulation plate or plates via the drainage holes. Thus, the bus bars installed on the insulation plates can be prevented from becoming electrically conductive to each other.

Further, in the first embodiment, because each drainage cylinder is fitted into the inner peripheral surface of the interruption rib of a lower plate, the insulation plates can be held at predetermined positions and hence prevented from being moved relatively by shocks. Similar to the first embodiment, because the drainage cylinders of the second embodiment are fitted one within another, the insulation plates can be held at predetermined positions and prevented from being relatively displaced by shocks.

Further, the construction of the electrical connection box is very simple. The drainage hole is formed on each insulation plate, and the drainage cylinder, interruption rib and peripheral rib project from the peripheral parts of the drainage hole. Thus, the present invention can be easily manufactured at a low cost.

Although the present invention has been fully described in connection with preferred embodiments thereof with reference to the accompanying drawings, it is to be noted that various changes and modifications are apparent to those skilled in the art. Such changes and modifications are to be understood as included within the scope of the present invention.

What is claimed is:

1. An electrical connection box for use in a vehicle, comprising:

a casing;

a plurality of bus bars; and a plurality of insulation plates having upper and lower surfaces, said bus bars and said insulation plates being arranged in said casing as a vertical stack in which said insulation plates alternate in the vertical direction with said bus bars, wherein each insulation plate in said vertical stack has a drainage aperture and a drainage wall extending downwardly from said drainage aperture thereof so as to define and surround a drainage passage from said drainage aperture, and at least each insulation plate below an upper insulation plate in said vertical stack has on its upper surface a flow interruption rib between each said drainage aperture and each said bus bar, each said interruption rib extending upwardly from said drainage aperture and said insulation plate.

2. The electrical connection box according to claim 1, wherein each said flow interruption rib is spaced from each said drainage aperture, and said drainage wall of each insulation plate contacts an upper surface of a next lower insulation plate in said vertical stack between said flow interruption rib and said drainage aperture of said next lower insulation plate, and said drainage walls and drainage apertures together form a continuous drainage path extending to a bottom of the vertical stack.

3. The electrical connection box according to claim 2, wherein the upper insulation plate in said vertical stack includes on its upper surface a flow interruption rib upstanding around said drainage aperture thereof.

4. The electrical connection box according to claim 1, wherein each drainage wall of each respective insulation plate extends to the bottom of said vertical stack through said drainage aperture of each insulation plate positioned lower in the vertical stack, said drainage wall of each respective insulation plate surrounding said drainage wall of each insulation plate positioned higher in the vertical stack.

5. The electrical connection box according to claim 1, wherein each drainage wall and each flow interruption rib is cylindrical in shape.

6. An electrical connection box for use in a vehicle, comprising:

a casing;

a plurality of bus bars; and a plurality of insulation plates having upper and lower surfaces, said bus bars and said insulation plates being arranged in said casing as a vertical stack in which said insulation plates alternate in the vertical direction with said bus bars, wherein each insulation plate in said vertical stack has a drainage aperture and a drainage wall extending downwardly from said drainage aperture thereof so as to define and surround a drainage passage from said drainage aperture, and said drainage wall of each insulation plate contacts an upper surface of a next lower insulation plate in said vertical stack adjacent said drainage aperture of said next lower insulation plate, said drainage walls and drainage apertures together forming a continuous drainage path extending to a bottom of the vertical stack.

7. An electrical connection box for use in a vehicle, comprising:

a casing;

a plurality of bus bars; and a plurality of insulation plates having upper and lower surfaces, said bus bars and said insulation plates being arranged in said casing as a vertical stack in which said insulation plates alternate in the vertical direction with said bus bars, wherein each insulation plate in said vertical stack has a drainage aperture and a drainage wall extending downwardly from said drainage aperture thereof so as to define and surround a drainage passage from said drainage aperture, and each drainage wall of each respective insulation plate extends to the bottom of said vertical stack through said drainage aperture of each insulation plate positioned lower in the vertical stack, said drainage wall of each respective insulation plate surrounding said drainage wall of each insulation plate positioned higher in the vertical stack.

* * * * *